FLUID PUMP ASSEMBLY

THE INVENTION IN GENERAL

This invention relates to a pump assembly, and more particularly, to one wherein means such as a servo pump are employed to impulse a bladder-like device which in turn impulses a retention chamber to pressurize a fluid retained therein. The servo pump may be operated to provide a single, sustained pulse; or it may be operated to provide intermittent pulses which are interspaced with alternate intake or suction pulses in the chamber.

There is no necessity for contact between moving parts in the pump assembly, and the assembly can produce a high capacity flow, even of heavily slurried liquids. The assembly is also reducible to a highly compact form, and it can be directly driven by the servo pump, or it can be remotely operated at great distances from the site of the servo pump, including at great depths in the surface of the earth, as for example, when it is used as a down-the-hole pump. The assembly is also convertible in part to other purposes, including earth drilling. For example, as shall be seen, the assembly combines a conduit and an interior pulse generating mechanism, and if desired, the pulse generating mechanism can be removed from the conduit to enable the conduit to be used for these other purposes, such as for earth drilling purposes. Alternatively, the mechanism may be maintained in the conduit, and operated either concurrently with the drilling operation, or alternately therewith.

Other advantages will also become apparent as the invention is described in more detail.

According to the invention, the pump assembly comprises means defining a fluid retention chamber having an inlet opening and an outlet opening therein, and check valve means adjacent the inlet and outlet openings, which are operative to limit the fluid flow therethrough to relatively inward and outward of the chamber, respectively, when there is a fluid pressure differential thereacross. The pump assembly also comprises hollow pulse generating means in the chamber, having a volume of less than that of the chamber, but including a normally contracted, resiliently flexible portion which is responsive to a fluid pressure pulse in the hollow of the pulse generating means, to flex in relation to the normally contracted condition thereof. It also comprises impulsing means which are operative to impart a fluid pressure pulse to the hollow of the pulse generating means, to cause the flexible portion of the pulse generating means to flex and impart a fluid pressure output pulse to a fluid medium retained in the chamber.

The chamber defining means may be rigid such that the volume of the chamber remains the same as the resiliently flexible portion of the pulse generating means undergoes flexure therein. Or the chamber defining means may include a relatively shiftable portion which is interconnected with the pulse generating means and responsive to flexure of the resiliently flexible portion thereof to vary the volume of the chamber.

The pulse generating means and the chamber may be coaxial with one another; or they may have relatively offset axes. Also, the pulse generating means and the inlet and outlet openings may be coaxial with one another so that the fluid passes about the pulse generating means in flowing between the openings; or the pulse generating means and the openings may have relatively offset axes so that the fluid bypasses the pulse generating means in flowing between the openings. However, in the latter case, the inlet and outlet openings themselves are preferably coaxial with one another.

The impulsing means may include a servo pump which is operatively interconnected with the hollow of the pulse generating means. Also, the hollow of the pulse generating means may have a mandrel-like finger inserted therein, which occupies a substantial portion thereof. The finger may be closed to the hollow, or it may be open to the hollow and the servo pump may be operatively interconnected with the hollow through the opening of the finger.

In certain of the presently preferred embodiments of the invention, the pulse generating means is accordian-like in construction, and is connected at one end to the chamber defining means. Where the chamber defining means is rigid, the volume of the chamber remains the same as the pulse generating means deflects in accordian-like fashion. Where the chamber defining means includes a relatively shiftable portion, that portion is preferably interconnected with the other end of the pulse generating means, so that it is responsive to the lengthwise deflection of the same to vary the volume of the chamber. Where the hollow of the pulse generating means has a finger inserted therein, the finger is preferably coaxial with the pulse generating means. Where the finger is open to the hollow, and the servo pump is interconnected with the hollow through the opening of the same, the servo pump preferably includes a piston-like member which is reciprocably guided in the finger to impart the fluid pressure pulse adjacent the opening. Also, the finger is preferably cantilevered into the hollow from the one end of the pulse generating means, and the opening of the finger is adjacent but spaced from the other end thereof. The resiliently flexible portion of the pulse generating means is disposed about the outer periphery of the finger, and the finger has longitudinally extending flutes in the outer peripheral surface thereof, to enable the fluid in the hollow to move lengthwise of the finger when the resiliently flexible portion of the pulse generating means assumes the contracted condition thereof.

The servo pump may be operative to impart intermittent fluid pressure pulses to the hollow of the pulse generating means; or it may impart only a single pulse, whereafter the pulse is sustained by the servo pump. This will depend, of course, on the utility to which the invention is applied.

One utility for the invention is as a small diameter, large capacity down-the-hole pump. In this and other such cases, the chamber defining means may take the form of an elongated pipe having spaced partitions therein defining the chamber together with the pipe. The inlet and outlet openings are located in the partitions, and the servo pump is interconnected with the hollow of the pulse generating means by an elongated feed pipe passing through the bore of the chamber defining pipe and communicating with the hollow through the partition having the inlet opening therein.

BRIEF DESCRIPTION OF THE DRAWINGS

These features will be better understood by reference to the accompanying drawings wherein three of the aforementioned embodiments are illustrated.

In the drawings.

Figure 1:
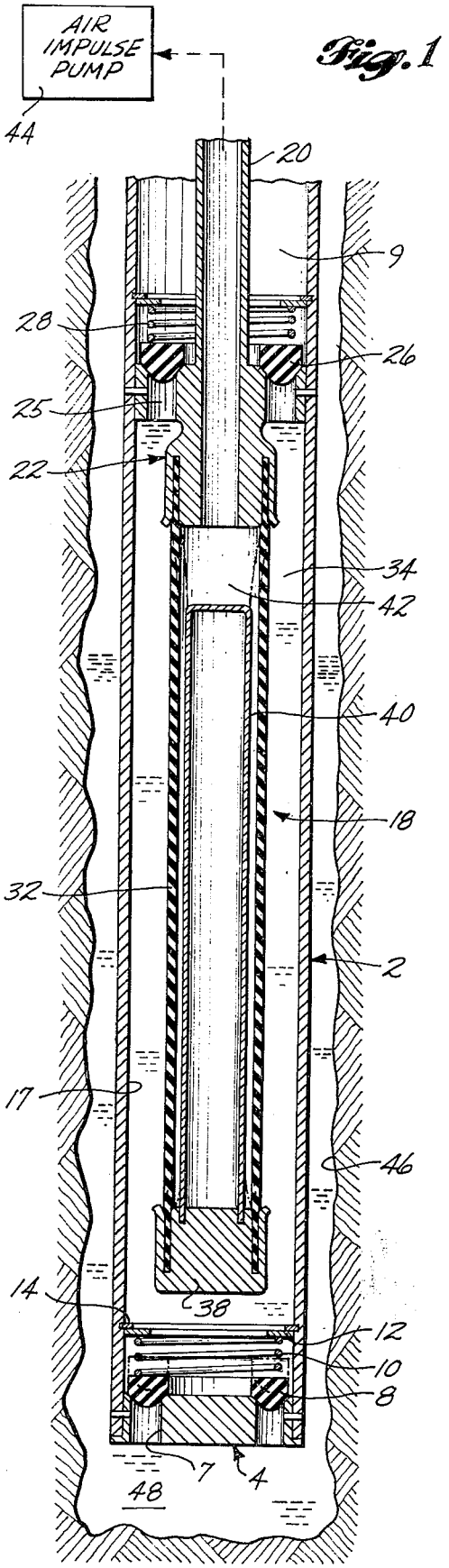
FIG. 1 is a vertical cross section of one embodiment in use as a down-the-hole pump.
Figure 2:
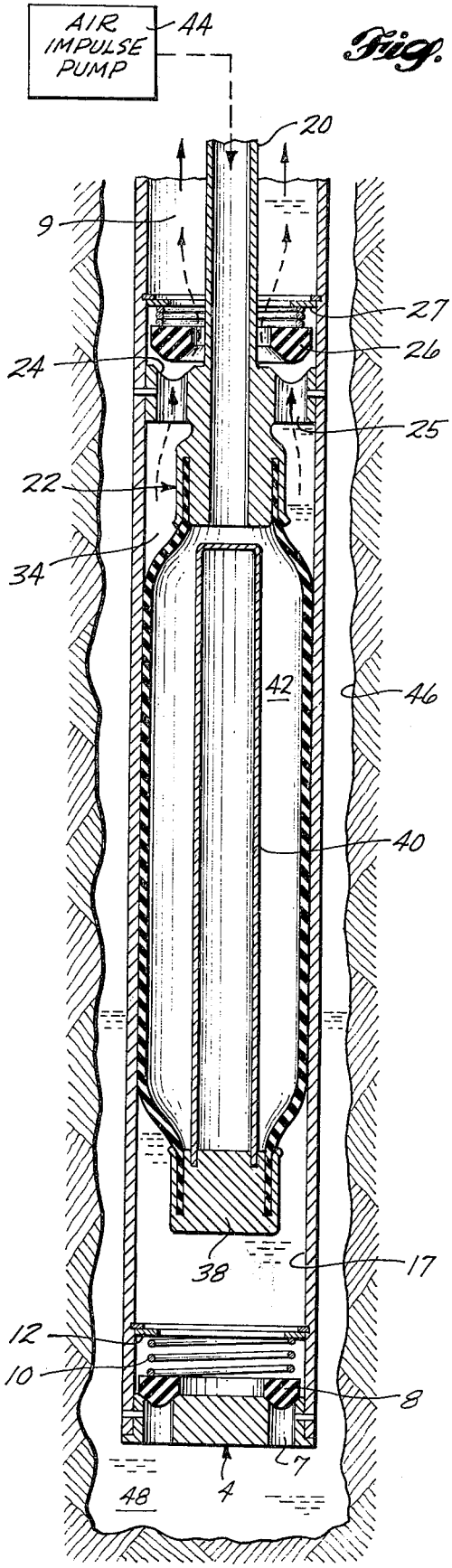
Figure 4:
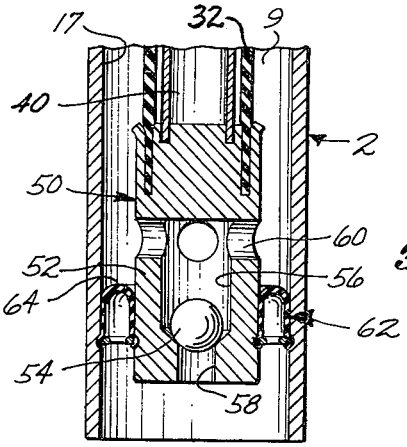
Figure 3:
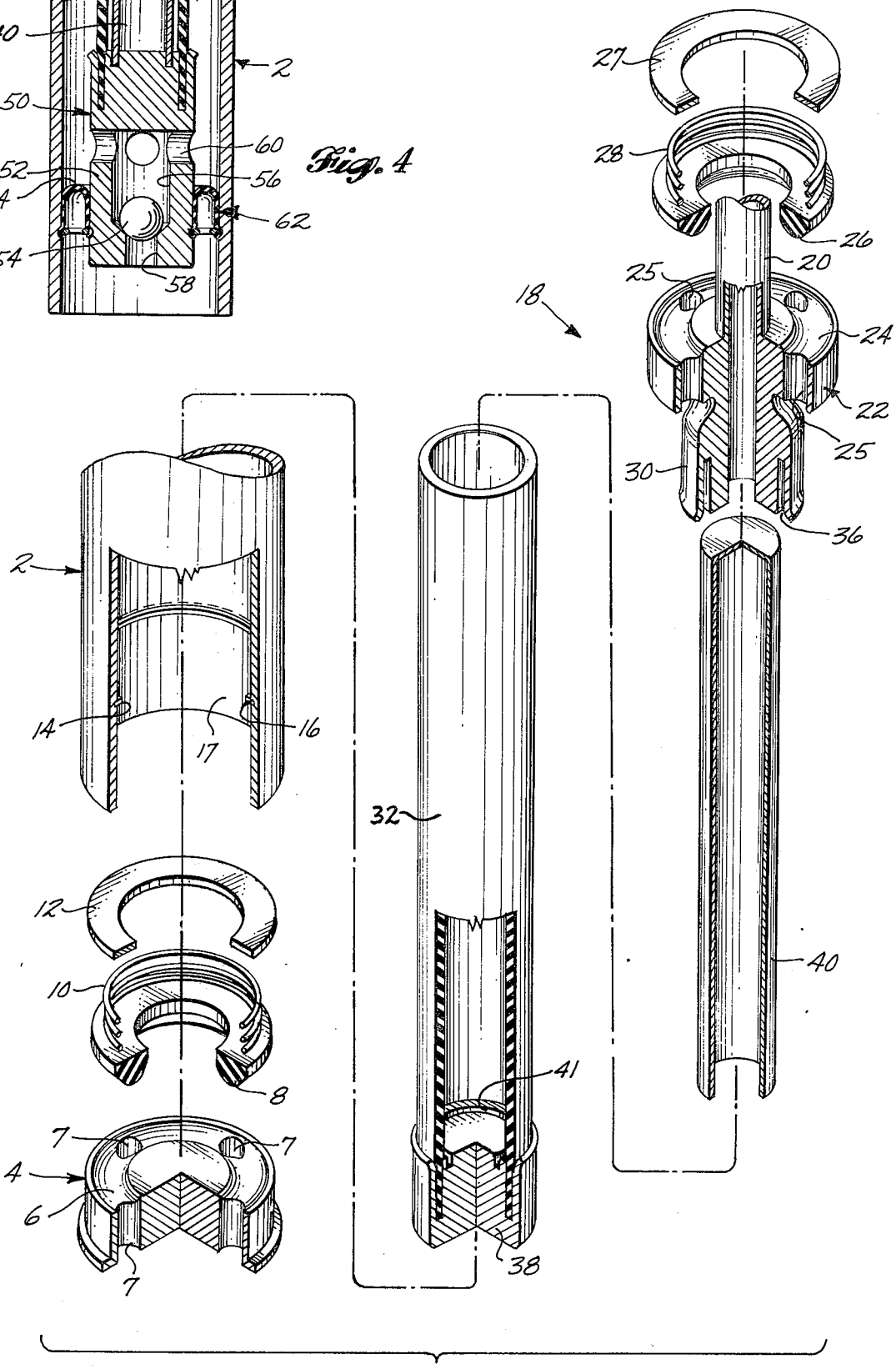
Figure 5:
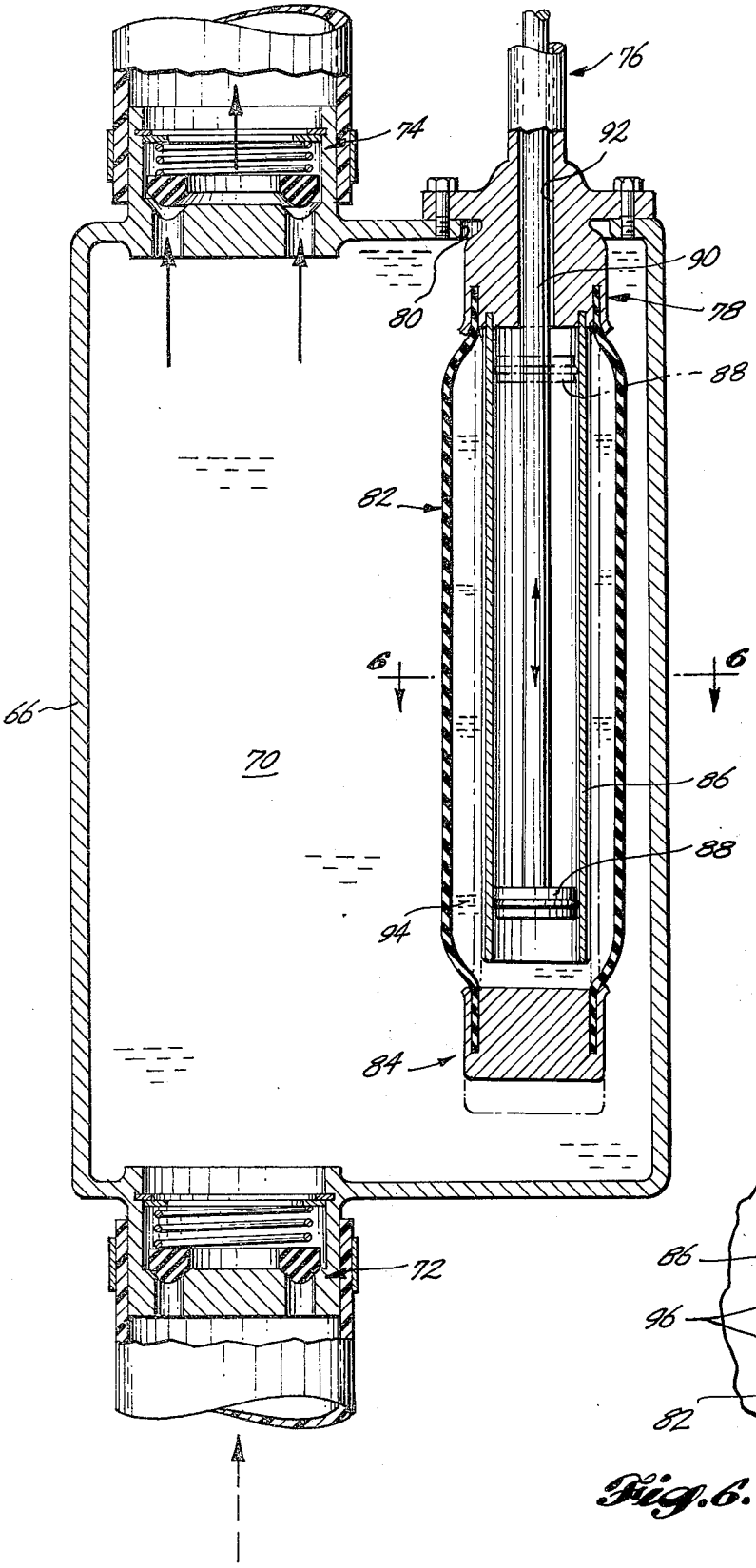
Figure 6:
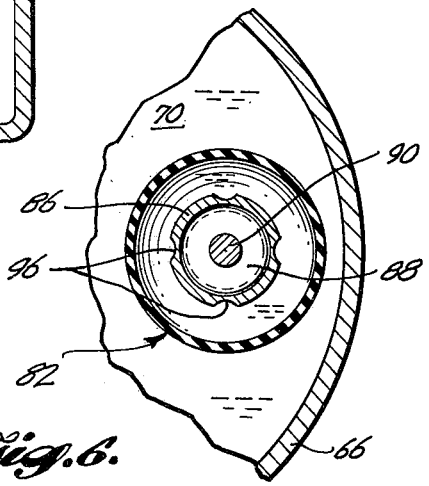

plug 4 in FIGS. 1 – 3, to perform as an inlet valve; whereas the other nipple, 74, is ported and check valve controlled in the manner of the head 22 in FIGS. 1 – 3, to perform as an outlet valve. Eccentric of the chamber, and on the opposite side thereof at the outlet end of the chamber, there is a third nipple 76 which has a bushed enlargement or head 78 thereon, that is similar to the head 22 in FIGS. 1 – 3, but unported. The nipple 76 is a separate fitting which is secured to the housing in an opening 80 so that the head 78 projects into the chamber. The head in turn is equipped with an elongated resiliently flexible sleeve 82 which has a plug 84 at the free end thereof. Interiorly, the sleeve is also equipped with a finger 86 which performs as a filler in the manner of the finger 40 in FIGS. 1 – 3. However, in this instance the finger is secured to the head and is open-ended adjacent the plug. Also, the finger has a piston 88 slidably engaged therein, the drive rod of which, 90, is slidably engaged in the bore 92 of the nipple 76. A hydraulic fluid 94 is captive in the sleeve and is compressed by the piston on its inward stroke, there being longitudinally extending flutes 96 in the exterior surface of the finger whereby the fluid moves lengthwise of the sleeve to inflate it as shown. Conversely, on its outward stroke, the piston generates a suction effect which collapses the sleeve around the exterior surface of the finger, as shown by the dot-dash condition of the sleeve in FIG. 5. Where the assembly is used as a force pump, the drive force for the piston is provided by a reciprocating drive mechanism (not shown) which is interconnected with the rod 90. Otherwise, such as where the assembly is used as a simple pressure applicator, the piston may be driven by a ram drive mechanism, also not shown.

Alternatively, the sleeve 32 or 82 may be secured at its ends to the surrounding walls of the chamber 34 or 70, and the walls may be equipped with one or more ports through which the inflation fluid is introduced and/or compressed around the sleeve, to flex the sleeve under tension inwardly of its diameter, rather than outwardly of its diameter as in FIGS. 1 – 6.

The sleeve 32 or 82 is preferably a braided wire reinforced elastomeric material. One such material is made by the Kleber Company of Paris, Cedex 16, France. Alternatively, the material can be expanded rubber or some other material which is suited to the function of the sleeve.

When the pulse generating mechanism 18 is employed in a convertible assembly, the subassembly 22, 26, 27, 28 is adapted as a piston-like member which is slidably engageable in the bore of a pipe such as the pipe 2, and equipped with latch means which are operative to interengage and lock the member to the pipe at a selected location therein. For example, see U.S. Pat. No. 3,292,717 for an example of such a latch means. The plug assembly 4, 8, 10, 12 may be adapted as a similarly equipped piston-like member which is engageable in the pipe at a more advanced location; or the pipe itself may be equipped with a preassembled plug assembly; or a single pipe section may be so equipped for insertion in a pipe string; or the sleeve 32 may have a piston-like member on the lower end thereof which is adapted to form the necessary lower chamber defining partition.

In some down-the-hole applications a column of liquid or similar medium may be used to maintain a piezometric head in the sleeve 32 or 82, which is substantially equal to the hoop tension of the same, so that on application of pressure to the medium the sleeve will immediately undergo expansion. That is, the height of the column can be set to assume a state of equilibrium with the hoop tension in the sleeve and any external pressure on the same, so that the applied pressure has an immediate effect on the sleeve. This also has the advantage of providing a constant relationship between the magnitude of the respective impulses and outpulses, such that the pump can be used to meter a steady flow.

Likewise, other means can be employed to equalize the flow from the pump. For example, the pump may be operated in conjunction with one or more other similar pumps to produce a smoother flow pattern, as for example, by interconnecting them through a swashplate or a shuttle valve.

What is claimed is:

1. In a pump assembly, a case having a head wall and a surrounding body wall defining a chamber which is open at one end thereof, a thimble-like pulse generating member in the chamber, comprising an elongated, resiliently flexible sleeve which is connected at one end to the head wall of the case and cantilevered toward the open end of the chamber in spaced relationship to the surrounding body wall of the case, and a cap which is disposed on the other end of the sleeve to form an enclosed cavity therewithin, and pulse generating means interconnected with the member to apply a fluid pressure input pulse to the cavity to cause the sleeve to flex and impart a fluid pressure output pulse to the annular portion of the chamber defined between the sleeve and the walls of the case, said cap having an annular member thereabout which is movably interposed between the cap and the surrounding body wall of the case to close the annular portion of the chamber to the open end thereof, and which is responsive to lengthwise contraction and extension of the sleeve to vary the volume of the annular portion of the chamber, and there being inlet and outlet openings in the cap and one of the walls of the case, respectively, for transmission of fluid into and out of the annular portion of the chamber, and check valve means adjacent the inlet and outlet openings, which are operative to limit the fluid flow therethrough to relatively inward and outward of the chamber portion, respectively, when there is a pressure differential thereacross.

2. The pump assembly according to claim 1 wherein the annular member takes the form of an annular diaphragm which is interconnected with the cap and the surrounding body wall of the case, and has one or more inverted U-shaped folds therein.

3. The pump assembly according to claim 2 wherein the cap has a T-valve therein, having a ball check valve member in the bore thereof.

4. The pump assembly according to claim 3 wherein the ball cooperates with an opening at the free end of the cap, and there are ports about the opposite end of the bore of the valve, which communicate with the annular portion of the chamber at a level between the diaphragm and the head wall of the case.

5. The pump assembly according to claim 1 wherein the cavity has a mandrel-like finger inserted therein, which occupies a substantial portion thereof.

6. The pump assembly according to claim 5 wherein the finger is closed to the cavity.

7. The pump assembly according to claim 1 wherein the sleeve is constructed of a braided wire reinforced elastomeric material.

8. In combination, an elongated pipe having a head wall across the bore thereof which together with the surrounding body wall of the pipe defines a chamber which is open at one end thereof, a thimble-like pulse generating member in the chamber, comprising an elongated, resiliently flexible sleeve which is connected at one end to the head wall of the pipe and cantilevered toward the open end of the chamber in spaced relationship to the surrounding body wall of the pipe, and a cap which is disposed on the other end of the sleeve to form an enclosed cavity therewithin, and pulse generating means interconnected with the member to apply a fluid pressure input pulse to the cavity to cause the sleeve to flex and impart a fluid pressure output pulse to the annular portion of the chamber defined between the sleeve and the walls of the pipe, there being means adjacent the cap to close the annular portion of the chamber to the open end thereof, inlet and outlet openings in the closure means and the head wall of the pipe, respectively, for transmission of the fluid into and out of the annular portion of the chamber, and check valve means adjacent the inlet and outlet openings, which are operative to limit the fluid flow therethrough to relatively inward and outward of the chamber portion, respectively, when there is a pressure differential thereacross, said pulse generating means including a feed line which extends within the bore of the pipe on the opposite side of the head wall from the chamber, and communicates with the cavity of the sleeve through the head wall, and a column of liquid in the feed line which generates a pressure head on the sleeve in the contracted condition thereof, and operates to transmit the applied fluid pressure input pulse to the cavity, and there being means connected with the pulse generating member to pretension the sleeve in the contracted condition thereof, so that the sleeve assumes a state of equilibrium with the pressure head of the liquid, whereby on the application of the fluid pressure input pulse to the liquid, the sleeve undergoes expansion in direct relation to the magnitude of the input pulse.

9. The combination according to claim 8 wherein the sleeve has an inherent hoop tension balancing the pressure head of the liquid.

10. The combination according to claim 8 wherein the closure means takes the form of a plug in the bore of the pipe, which is spaced apart from the cap and operative to close the open end of the chamber.

* * * * *

United States Patent [19]

Sloan

[11] 3,957,402

[45] May 18, 1976

[54] DEWATERING PUMP ASSEMBLY HAVING A HEAT EXCHANGER

[76] Inventor: Albert H. Sloan, 4201 Kean Road, Fort Lauderdale, Fla. 33314

[22] Filed: Feb. 6, 1975

[21] Appl. No.: 547,378

Related U.S. Application Data

[62] Division of Ser. No. 415,997, Nov. 15, 1973, Pat. No. 3,910,728.

[52] U.S. Cl. ..... 417/367; 415/178

[51] Int. Cl.[2] ..... F04B 17/00

[58] Field of Search ..... 417/366, 367, 375, 390; 165/122; 415/178

[56] References Cited

UNITED STATES PATENTS

| | | | |
|---|---|---|---|
| 1,242,961 | 10/1917 | Mansell et al. | 165/122 |
| 1,866,846 | 7/1932 | Fink | 165/122 |
| 2,346,372 | 4/1944 | Foottit | 417/375 |
| 2,593,729 | 4/1952 | Coberly | 417/390 |
| 3,398,694 | 8/1968 | Lerch | 417/375 |

*Primary Examiner*—William L. Freeh
*Assistant Examiner*—G. P. La Pointe
*Attorney, Agent, or Firm*—James E. Nilles

[57] ABSTRACT

A dewatering pump assembly for water pumping apparatus for pumping water from excavations or other holes in the ground and upwardly to a more or less remote discharge area. The apparatus finds particular utility for use, for example, by contractors, utility companies, or the like, and includes a power source, preferably mobile or easily transportable, such as an internal combustion engine or an electric motor or other power sources. A pressure fluid tank assembly and a pressure fluid pump is connected directly to the power source, and a water pump assembly is located down in the water at the bottom of the hole or excavation and includes a housing in which an impeller, a fluid motor, and the connecting drive shaft all are located. The fluid pressure pump which is driven directly by the power source is connected by long flexible conduits to the motor of the pump assembly. The pump assembly includes a heat exchanger which is secured on the lower end of assembly and the pressure fluid conduits act to convey a portion of the pressure fluid to and from the heat exchanger to thereby cool the pressure fluid. The heat exchanger is located strategically in the water being pumped to thereby efficiently transfer heat from the pressure fluid to the water being pumped.

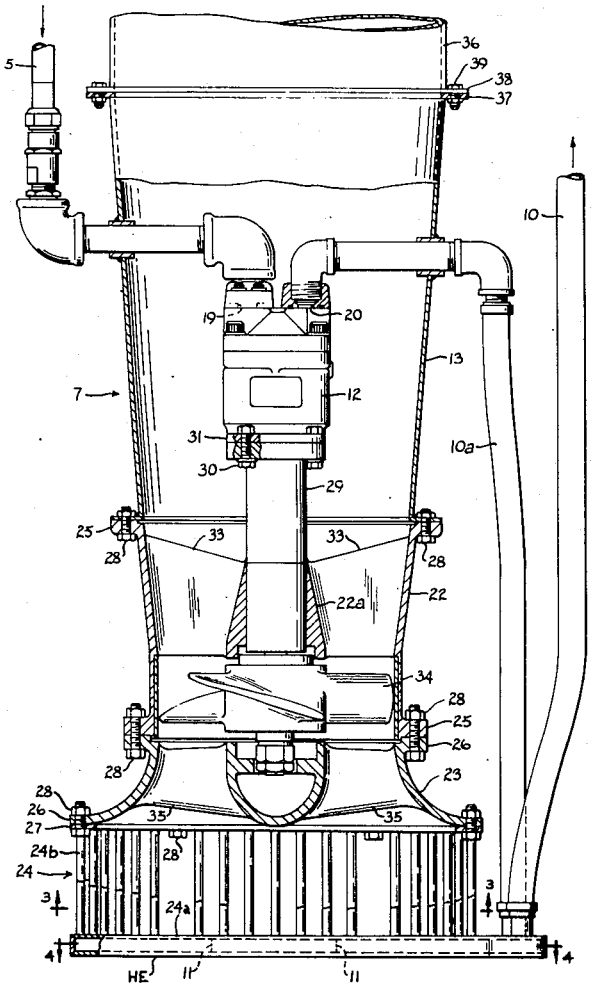

7 Claims, 4 Drawing Figures